United States Patent [19]

Kinderman

[11] 4,312,449

[45] Jan. 26, 1982

[54] APPARATUS FOR THE DISPLAY OF GOODS

[76] Inventor: John Kinderman, 300 French Rd., Newtown Square, Pa. 19073

[21] Appl. No.: 138,694

[22] Filed: Apr. 9, 1980

[51] Int. Cl.[3] ..... B65D 73/00; B65D 85/62

[52] U.S. Cl. ..... 206/466; 206/482; 206/493; 206/526

[58] Field of Search ..... 206/466, 482, 493, 526, 206/44.11

[56] References Cited

U.S. PATENT DOCUMENTS

| | | | |
|---|---|---|---|
| 1,402,635 | 1/1922 | Meyer | 206/466 |
| 1,785,498 | 12/1930 | Savageau | 206/466 |
| 1,940,078 | 12/1933 | Cooper | 206/466 |
| 2,030,996 | 2/1936 | Lustig | 206/466 |
| 2,272,623 | 2/1942 | Runner | 206/466 |
| 2,656,917 | 10/1953 | Hollis | 206/482 |
| 3,952,872 | 4/1976 | Consiglio, Jr. | 206/526 |
| 4,111,297 | 9/1978 | Paulin | 206/44.11 |

*Primary Examiner*—William T. Dixson, Jr.
*Attorney, Agent, or Firm*—Woodcock, Washburn, Kurtz, Mackiewicz & Norris

[57] ABSTRACT

Apparatus for the display of goods comprising a backing card having tongues formed at each of a plurality of display locations, sections of the backing card being removed from either side of each of the tongues. The goods are affixed to tabs having slots formed therein for interaction with the tongues, and shoulders formed therein for interaction with the removed sections of the card, whereby accidental dislodgement of the tabs from the backing card is substantially precluded.

3 Claims, 5 Drawing Figures

APPARATUS FOR THE DISPLAY OF GOODS

FIELD OF THE INVENTION

This invention relates to means for conveniently displaying goods for merchandising purposes. More particularly, the invention relates to an arrangement whereby a plurality of packages of small, relatively lightweight goods can be conveniently displayed on a card so that they may readily be examined and detached from the card by potential customers, and at the same time prevented from accidental dislodgement.

BACKGROUND OF THE INVENTION

It will be appreciated by those skilled in merchandising and packaging that in general the attractiveness of a package display and the ready access of the package to purchasers are important factors in the sale of the packaged goods. Moreover, it will be recognized by those skilled in merchandising that it is desirable that a manufacturer of packaged goods provide for their display by a retailer such that the retailer will be inclined to purchase the goods for resale, and the consumer will be attracted to the display. For these reasons, packaged goods are often arranged such that they can be attractively displayed by the retailer and the packages can readily be replaced on display as they are sold. For example, U.S. Pat. No. 4,111,297 to Paulin, describes a Cartridge for Hardware Packages in which a plurality of roughly rectangular boxes of small hardware items is packaged in a larger box, with each of the individual boxes provided with a hole at its top arranged to interact with a display rod. The larger box is arranged so that all of the smaller boxes containing the hardware can be placed on a rod simultaneously without the necessity of individual handling of each small box by the retailer. In this way, the convenience of the retailer is served. Another approach is described in U.S. Pat. No. 3,952,872 to Consiglio, Jr., for a Package for Carded Merchandise. In both the Consiglio, Jr. and the Paulin approaches, however, the retailer is required to replace the individual packages upon the display means from time to time. Moreover, both suffer from the disadvantage that by tilting the display apparatus, the individual packages can be dislodged from their supporting rod. There is therefore a need in the art for a convenient package display arrangement which does not require individual placement of packages upon a display means by a retailer and which prevents the packages from being detached from the arrangement by dislodgement or tilting of the display means.

OBJECTS OF THE INVENTION

It is therefore an object of the invention to provide apparatus for an attractive display of packaged goods.

Another object of the invention is to provide a package display in which the packaged goods can be arranged for display on a card at their point of manufacture, and in which comparatively rough handling of the displayed packages during shipping, for example, may be tolerated without the packages becoming dislodged from the display card.

A further object of the invention is to provide an attractive display apparatus, which is easily made and which does not require substantial additional materials, effort or cost for its use.

Still a further object of the invention is to provide an inexpensive and simple means for the display of packaged goods whereby the goods can be individually displayed in packages of a size appropriate for individual sales to consumers, but need not be individually handled in such sizes by the retailer.

Yet another object of the invention is to provide a package display apparatus in which the goods are prevented from being dislodged from the display apparatus.

SUMMARY OF THE INVENTION

The invention satisfies the above objects by the provision of apparatus for display of articles, according to which the articles to be sold are packaged in individual, relatively lightweight packages, of plastic for example, each of which is secured (e.g., by stapling or sewing) to an individual tab of a suitable material such as cardboard or plastic, for example. The goods can also be shrink-wrapped to the tab, or otherwise affixed thereto. In accordance with the invention, the tab is provided with a slot so sized as to fit with one of a plurality of tongues formed integrally with a display card. Sections are also removed from the display card so that when the tongue is inserted into the slot of the tab, shoulders formed on the tab interact with the removed sections of the display card whereby part of the tab protrudes from one side of the display card, and part from another, to prevent accidental dislodgement of the tab from the display card.

BRIEF DESCRIPTION OF THE DRAWINGS

The invention will be better understood by reference to the accompanying drawings in which.

DESCRIPTION OF THE PREFERRED EMBODIMENTS

As described above, it is desirable in the merchandising of goods, particularly relatively small, lightweight goods, that they be provided in individual packages of a size conveniently usable by a consumer and arranged for visual display. Additionally, it is desirable that the manufacturer of the goods arrange for their display in a manner such that the retailer need do as little as possible in arranging the display of the goods. Still further, it is additionally desirable that these aims be achieved in a way such that the display arrangement chosen is secure during shipping conditions, i.e., that the goods do not become dislodged from the display means and are still readily displayed with a minimum of effort by the retailer.

Figure 1:
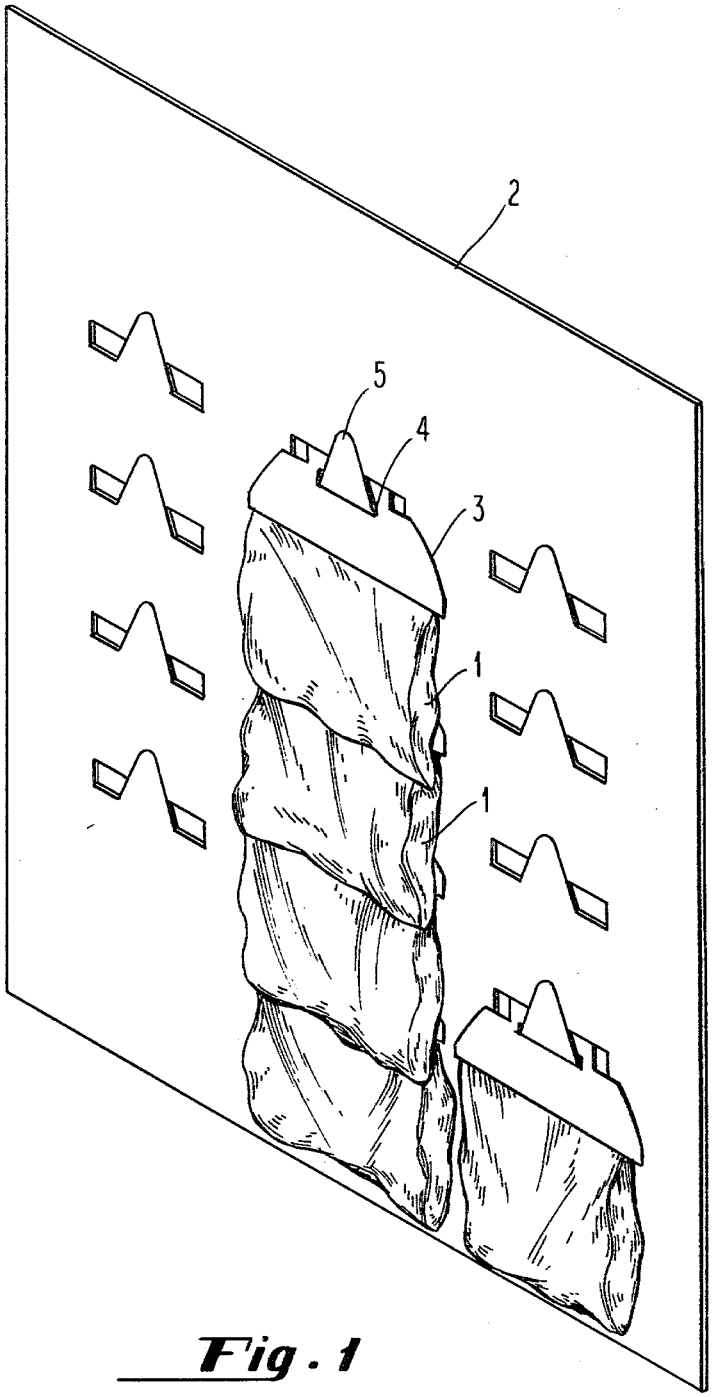
FIG. 1 is a perspective view of a display apparatus according to a preferred form of the invention, comprising a display card and a number of tabs with goods mounted thereon in packages for display.

Reference to the figures will make clear the manner in which the invention achieves these ends. FIG. 1 shows an overall perspective view of a display apparatus constructed according to the invention. As shown in FIG. 1, a plurality of packages or bags 1 containing goods to be sold are displayed on a display card 2 formed of cardboard or rigid plastic, for example. Each of the bags 1, which may be of transparent plastic, paper, cloth or other suitable material is attached, by stapling, glueing or other suitable means to a tab 3. Tab 3 may be formed of cardboard, plastic, rigid paper or other material. Each tab 3 is provided with a slot 4 which is sized so as to mate with a tongue 5 formed integrally from the backing card 2 at a plurality of storage locations. The tab 3 and the display locations are arranged to interact such that the consumer can readily detach the packaged goods from the display card 2 for purchase. By virtue of the construction shown, the packaged goods are also prevented from becoming accidentally dislodged simply by rough handling.

The manner by which accidental dislodging is prevented but ready disengagement of the goods from the backing card 2 by a consumer is made possible is described with reference to FIGS. 2–5.

Figure 2:
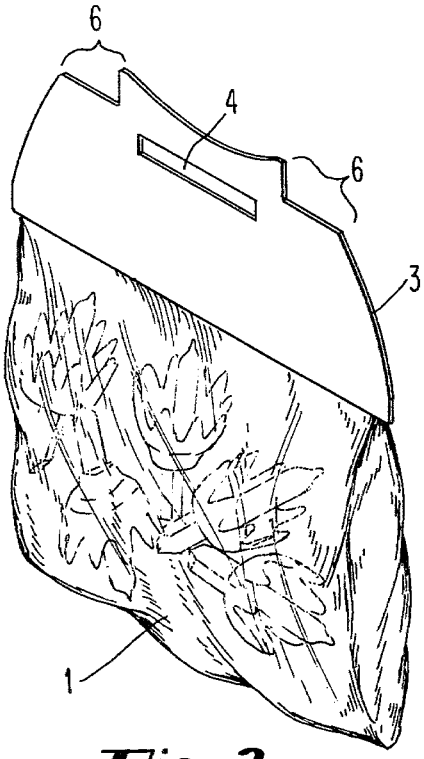
FIG. 2 shows a package of goods attached to a tab constructed in accordance with one form of the invention.
Figure 3:
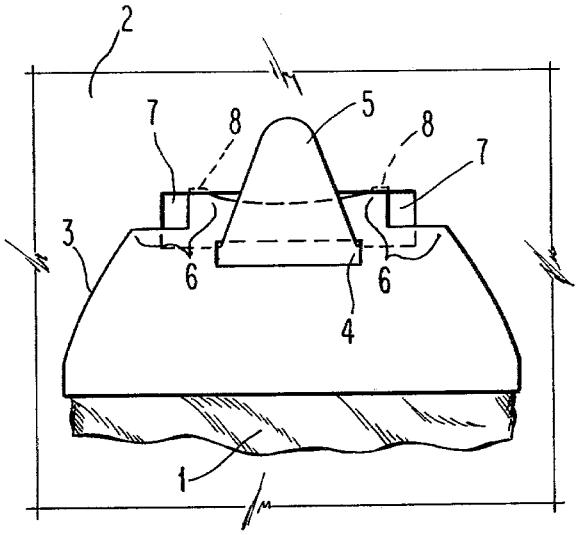
FIG. 3 shows an arrangement by which the tab having attached thereto a package containing goods as shown in FIG. 2 may be affixed to a display card constructed in accordance with the invention.

FIG. 2 shows one embodiment of the consumer-scaled package, i.e., a quantity of goods equal to the usual consumer requirement is in a package attached to a tab 3. As shown in FIG. 2, this is achieved by placing the goods, shown in phantom, in a bag 1 suitably attached to the tab 3 which may comprise a single layer of a thin inexpensive material such as cardboard, for example. Tab 3 has a slot 4 formed therein, as well as dog-leg or S-shaped shoulders 6 formed in the upper portions of tab 3. Tab 3 can be made by a simple stamping operation, as will be appreciated by those skilled in the art. FIG. 3 shows how the shoulders 6 interact with sections 7 removed from the backing card 2, so as to prevent the tab 3 from being accidentally dislodged from the backing card 2. As shown in FIG. 3, the slot 4 interacts with the tongue 5 so as to support the weight of the goods carried within the bag 1. It will be appreciated that removed sections 7 can be formed at the same time as the tongue 5 by a simple stamping operation performed simultaneously at a plurality of locations on the backing card 2.

Figure 4:
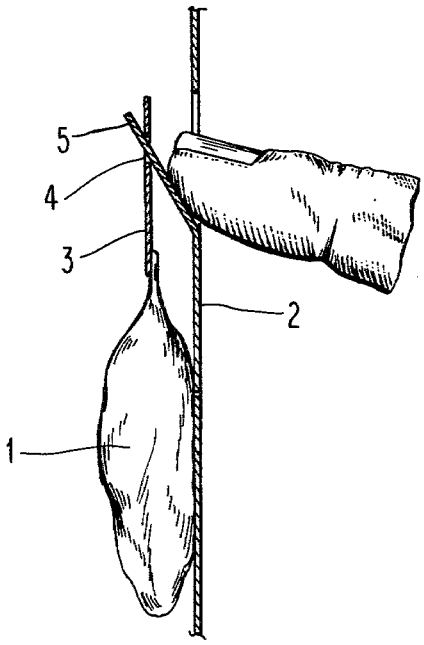
FIG. 4 shows how a tab with the attached package as shown in FIG. 2 can be mounted on the tongue of a card constructed in accordance with the invention.
Figure 5:
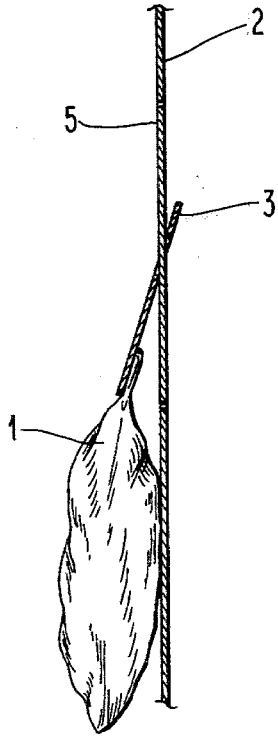
FIG. 5 shows how a tab such as shown in FIG. 2 is prevented from dislodgement from a display card constructed in accordance with the invention.

FIGS. 4 and 5 illustrate how dislodgement of the tab 3 from the backing card 2 is prevented. The tongue 5, the shoulders 6 of the tabs 3, and the sections 7 removed from the card 2 are constructed and sized so that the tongue 5, as shown in FIG. 4, must be bent in a first direction away from the display card to enable the mounting of tab 3, via the slot 4, on the tongue 5. As shown in FIG. 5, the natural resiliency of the material from which the backing card 2 is made, typically an inexpensive cardboard material, then causes the tongue 5 to return to its original coplanar position with respect to the backing card 2. This causes the uppermost section or ear 8 (FIG. 3) of the tab 3 to be located above the uppermost section of the removed portions 7 of the card 2 whereby the tab 3 is prevented from falling off tongue 5 even if, due to rough handling or the like, the tongues 5 should be jostled somewhat out of the plane of the backing card 2. In order to achieve this interaction, the height of the ears 8, measured from the top of the slot 4, should be somewhat greater than the parallel dimension of the section 7 removed from the backing card 2. That is, the height of the shoulders 6 is greater than the height of the removed sections 7. In this construction, the tongue must be bent away from the card 2 in a first direction so as to enable the detachment of the tab 3 from the backing card 2. Accidental dislodgement of the package from the display card is thus substantially eliminated.

It will be understood by those skilled in the art that essentially the opposite motion is required to dislodge or remove the tabs 3 and the associated goods from the backing card 2. That is, a consumer, in order to remove the goods from the backing card, need pull on the tab 3 until the tongue stands out a distance from the surface of the card 2 to enable the ears 8 to pass between the tongue 5 and body of the card 2. By gauging the resiliency of the material, the weight of the goods and the sizing of the ears, the force required to pull the tongue to this extent can be made such that accidental dislodgement due to handling is essentially eliminated. In this way, the retailer's chore is eased because when he receives a large number of backing cards already filled with goods mounted on tabs, in bags or otherwise, he need only prop the display card up, hang it, or otherwise make it available to the public eye. With respect to the ease of dislodgement, it will be understood that the length to which the tongue 5 extends above the upper line of the removed sections 7 is significant, i.e., if the tongue ends at the same level as the top of the removed sections 7, it will be appreciated that it need not be bent as far away from the card to allow dislodgement of the tabs therefrom, thus enabling more ready selection of the goods by a customer but concomitantly making it easier for the tabs to become accidentally dislodged from the card. However, the inventive interaction of the shoulders, the ears and the removed sections remains the same regardless of the length of the tongue.

It will be understood that the above disclosure and the appended claims describe an apparatus for the display of goods which satisfies the need of the art and objects of the invention listed above. While inexpensive, readily manufactured and useful with a wide variety of goods, it satisfies the objects of providing a means for display of goods which is very simple of implementation by a retailer yet which is not susceptible to dislodgement of the goods from the display card during transport. While the goods are readily detachable from the card by a consumer desiring to purchase them, their accidental dislodgement is minimized through exploitation of the naturally resilient qualities of the material used to form the backing card. Finally, it will be understood that the invention has applicability beyond the display of goods in a bag such as is shown. The goods can be affixed to the tab 3 by any method which will permit a slot 4 and shoulders 6 to be formed in the tab 3 so as to permit interaction with the tongue 5 and the removed section 7 of the backing card 2 respectively.

It should be understood that while the present invention has been described in considerable detail with respect to certain specific embodiment thereof, it should not be considered limited to such embodiments but may be used in other ways without departure from the spirit of the invention and the scope of the appended claims.

What is claimed is:

1. Apparatus for display of articles, comprising a backing card and a plurality of tabs to which said articles may be affixed, said card being formed identically at each of an equal plurality of locations to comprise a tongue and to remove two substantially symmetric sections of said card disposed on either side of each of said tongue, said tabs having slots formed therein sized to mate with said tongues, and shoulders formed on either side of said slots, said shoulders being sized to fit said removed sections so that only the portion of each said tab containing said shoulders can protrude through said removed sections, each said tongue fitting said card such that said tongue must be bent in a direction away from a first side of said card so as to permit said tongue to be inserted in a slot in a tab, whereby said shoulders may protrude through said removed sections in a direction away from the second side of said card, whereby removal by dislodgement of said tabs from said card is prevented.

2. Apparatus for the display of packaged goods, wherein each package of said goods is individually affixed to a tab, each said tab being adapted to interact in a substantially identical fashion with one of a plurality of substantially identical display means formed on a card for display of said goods, each tab having a slot formed therein and substantially similar shoulders formed on opposite sides of said slot, and each of said display means comprising a tongue sized to fit through the slot in one of said tabs to support said tab, and having substantially identical sections removed from said card on either side of said tongue, the height of said shoulders being greater than the height of said removed sections, whereby accidental dislodgement of said tabs from said card is substantially precluded.

3. Apparatus for the display of packaged goods comprising:

a support member including mounting means at each of a plurality of display locations at the face of said member for mounting a package of goods for display;

each said mounting means comprising a tongue secured to said support member and a pair of apertures in said support member each of which apertures is disposed adjacent and on each side of said tongue, said tongue being resiliently movable both away from and toward the face of said support member such that a single opening in said support member is formed by said pair of apertures at each said display location when said tongue is moved away from the face of said support member;

each said package comprising receptacle means containing said goods;

a tab member attached to said receptacle means, said tab member having a slot formed therein adapted to mate with said tongue when said package is mounted upon said support member for display;

each said tab member including shoulders adjacent said slot constructed and arranged such that the shoulders of said tab protrude through said single opening in said support member when said package is mounted upon said support member for display, said shoulders being sized such that the uppermost portion of said shoulders are disposed above the upper edges of each of said pair of apertures, whereby dislodgemnt of said tabs mounted upon said support member is prevented.

* * * * *